US009058048B2

(12) United States Patent
Teong et al.

(10) Patent No.: US 9,058,048 B2
(45) Date of Patent: Jun. 16, 2015

(54) VOLTAGE REGULATOR HAVING ERROR AMPLIFIER

(71) Applicant: KABUSHIKI KAISHA TOSHIBA, Minato-ku, Tokyo (JP)

(72) Inventors: Hansen Teong, Tokyo (JP); Masayoshi Takahashi, Kanagawa-ken (JP); Hirokazu Kadowaki, Kanagawa-ken (JP); Masatoshi Watanabe, Kanagawa-ken (JP); Kenji Kanamaru, Kanagawa-ken (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 52 days.

(21) Appl. No.: 13/789,541

(22) Filed: Mar. 7, 2013

(65) Prior Publication Data

US 2014/0077780 A1 Mar. 20, 2014

(30) Foreign Application Priority Data

Sep. 14, 2012 (JP) ..... 2012-203059

(51) Int. Cl.

| | |
|---|---|
| ***H02M 3/156*** | (2006.01) |
| ***G05F 1/46*** | (2006.01) |
| ***G05F 1/565*** | (2006.01) |
| ***G05F 1/575*** | (2006.01) |

(52) U.S. Cl.

CPC *G05F 1/46* (2013.01); *G05F 1/565* (2013.01); *G05F 1/575* (2013.01)

(58) Field of Classification Search

USPC ..... 320/150–154; 323/242, 243, 246, 271, 323/273–276, 282–285, 907; 361/18, 103, 361/104, 111

See application file for complete search history.

(56) References Cited

U.S. PATENT DOCUMENTS

| | | | | |
|---|---|---|---|---|
| 5,744,944 | A * | 4/1998 | Danstrom | 323/284 |
| 6,310,467 | B1 * | 10/2001 | Sauer | 323/273 |
| 6,650,097 | B2 | 11/2003 | Sakurai | |

(Continued)

FOREIGN PATENT DOCUMENTS

| | | | |
|---|---|---|---|
| JP | 2002136123 | A | 5/2002 |
| JP | 2002-297248 | A | 10/2002 |
| JP | 2007-109267 | A | 4/2007 |

OTHER PUBLICATIONS

Japanese Office Action dated Jan. 16, 2015, issued in counterpart Japanese Application No. 2012-203059.

*Primary Examiner* — Adolf Berhane
*Assistant Examiner* — Gary Nash
(74) *Attorney, Agent, or Firm* — Holtz, Holtz, Goodman & Chick PC

(57) ABSTRACT

According to an embodiment, a voltage regulator having an output transistor, a voltage dividing circuit, an error amplifier, a detection circuit and a phase compensation capacitance circuit is provided. The output transistor has one end to which a power supply voltage is supplied, a control terminal to which a control signal is input, and the other end which outputs an output voltage. The voltage dividing circuit is connected between the other end of the output transistor and a first reference voltage. The error amplifier is configured to output the control signal according to the difference between a divided voltage and a second reference voltage. The detection circuit is configured to detect an operation environment. The phase compensation capacitance circuit is configured to adjust a phase compensation capacitance between the other end of the output transistor and an input terminal of the error amplifier, in accordance with the detected operation environment.

13 Claims, 12 Drawing Sheets

(56) References Cited

U.S. PATENT DOCUMENTS 7,355,469 B2 4/2008 Shimizu
7,919,954 B1 * 4/2011 Mannama et al. ..... 323/272
2003/0102851 A1 * 6/2003 Stanescu et al. ..... 323/280
2010/0213913 A1 8/2010 Shito

* cited by examiner

VOLTAGE REGULATOR HAVING ERROR AMPLIFIER

CROSS-REFERENCE TO RELATED APPLICATION

This application is based upon and claims the benefit of priority from the prior Japanese Patent Application No. 2012-203059, filed on Sep. 14, 2012, the entire contents of which are incorporated herein by reference.

FIELD

Embodiments described herein relate generally to a voltage regulator.

BACKGROUND

A voltage regulator is a circuit to output a predetermined output voltage based on a power supply voltage supplied from outside. Characteristics of the voltage regulator are deteriorated in accordance with change in an external operation environment such as a temperature or a frequency of a ripple of the power supply voltage.

As the temperature rises, the voltage regulator becomes oscillated easily, and an overshoot of the output voltage which occurs at the time of rising of the output voltage, and an undershoot which occurs at the time of falling of the output voltage are respectively increased. Further, as the frequency of the ripple of the power supply voltage is increased, the ripple is increased in the output voltage of the voltage regulator.

DETAILED DESCRIPTION

Figure 1:
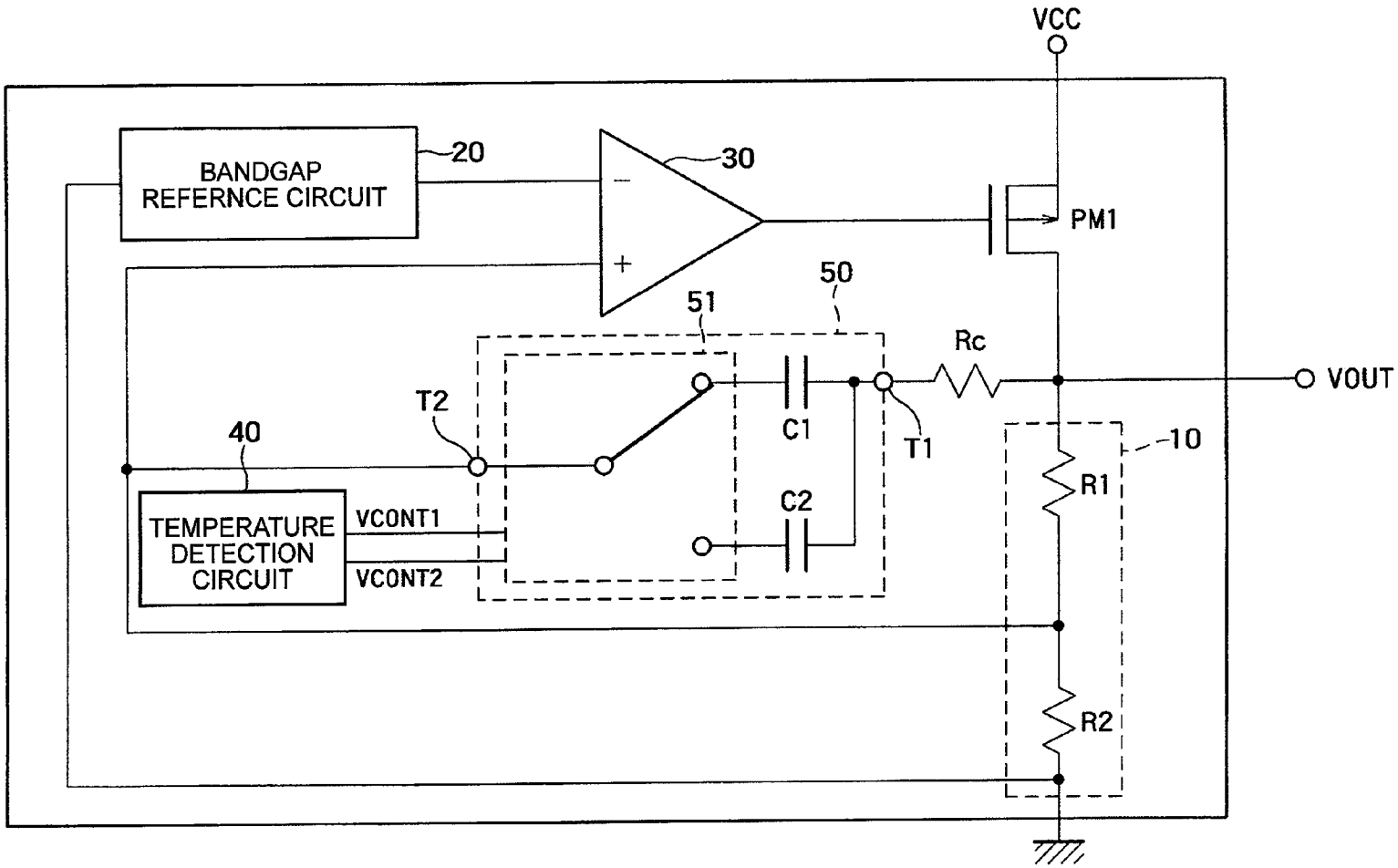
FIG. 1 is a circuit diagram showing a voltage regulator according to a first embodiment.

According to an embodiment, a voltage regulator is provided. The voltage regulator has an output transistor, a voltage dividing circuit, an error amplifier, a detection circuit, and a phase compensation capacitance circuit. The output transistor has one end to which a power supply voltage is supplied, a control terminal to which a control signal is input, and the other end which outputs an output voltage. The voltage dividing circuit is connected between the other end of the output transistor and a first reference voltage. The voltage dividing circuit is configured to output a divided voltage according to the output voltage. The error amplifier has a first input terminal to which the divided voltage is provided, and a second input terminal to which a second reference voltage is provided. The error amplifier is configured output the control signal according to the difference between the divided voltage and the second reference voltage. The detection circuit is configured detect an operation environment. The phase compensation capacitance circuit is configured adjust a phase compensation capacitance between the other end of the output transistor and the first input terminal of the error amplifier in accordance with the operation environment.

Hereinafter, further embodiments will be described with reference to the drawings. In the following description, an insulated gate field effect transistor is referred to as a "MOS transistor".

In the drawings, the same reference numerals denote the same or similar portions respectively.

A first embodiment will be described with reference to FIGS. 1 to 5. FIG. 1 is a circuit diagram showing a voltage regulator according to a first embodiment. As shown in FIG. 1, the voltage regulator is provided with a P-channel MOS transistor PM1 as an output transistor, a voltage dividing circuit 10, a bandgap reference circuit 20, an error amplifier 30, a temperature detection circuit 40, a phase compensation capacitance circuit 50, and a phase compensation resistor Rc. The temperature detection circuit 40 serves as a detection circuit for detecting an operation environment of the voltage regulator. The voltage regulator can be composed of a semiconductor integrated circuit.

The P-channel MOS transistor PM1 has a source as one end of the transistor PM1, a gate as a control terminal, and a drain as the other end of the transistor PM1. The source receives a power supply voltage VCC. The gate receives a control signal is supplied. The drain outputs an output voltage VOUT. The P-channel MOS transistor PM1 may be referred to as a "pass transistor".

The voltage dividing circuit 10 is connected between the drain of the P-channel MOS transistor PM1 and a ground as a reference voltage. The voltage dividing circuit 10 outputs a divided voltage according to the output voltage VOUT of the voltage regulator. Specifically, the voltage dividing circuit 10 has a resistor R1 and a resistor R2 which are connected to each other in series. An end of the resistor R1 is connected to the drain of the P-channel MOS transistor PM1. Both ends of the resistor R2 are connected to the other end of the resistor R1 and the ground, respectively. The divided voltage is output from a connection point of the resistor R1 and the resistor R2.

The bandgap reference circuit 20 outputs a reference voltage with respect to the ground as a base. The reference voltage has a small temperature dependency.

The divided voltage is provided to a non-inverted signal input terminal as a first input terminal of the error amplifier 30. The reference voltage is provided to an inverted signal input terminal as a second input terminal of the error amplifier 30. The error amplifier 30 outputs a control signal to the gate of the P-channel MOS transistor PM1. The control signal is provided in accordance with a difference between the divided voltage and the reference voltage to the gate of the P-channel MOS transistor PM1. Specifically, the error amplifier 30 controls the control signal so as to make the divided voltage equal to the reference voltage. Accordingly, the output voltage VOUT becomes substantially constant output voltage and is output from the drain of the P-channel MOS transistor PM1.

The temperature detection circuit 40 detects a temperature as an operation environment of the voltage regulator. In the embodiment, when the temperature is lower than a predetermined switchover temperature TEs, the temperature detection circuit 40 outputs a high level control signal VCONT1 and a low level control signal VCONT2. When temperature is equal to or higher than the predetermined switchover temperature TEs, the temperature detection circuit 40 outputs a low level control signal VCONT1 and a high level control signal VCONT2.

The phase compensation capacitance circuit 50 adjusts a phase compensation capacitance between a first terminal T1 and a second terminal T2 so as to approach a predetermined reference capacitance in accordance with a temperature detected by the temperature detection circuit 40. The phase compensation capacitance has a temperature dependency.

In the embodiment, the phase compensation capacitance circuit 50 is provide with a first capacitive element C1, a second capacitive element C2, and a capacitance control circuit 51 which will be described below.

The first capacitive element C1 has a temperature dependency. The second capacitive element C2 has a temperature dependency and also has a larger capacitance than the first capacitive element C1.

Based on the control signals VCONT1, VCONT2, when the temperature detected by the temperature detection circuit 40 is equal to or higher than the switchover temperature TEs, the capacitance control circuit 51 connects both ends of the second capacitive element C2 to the first terminal T1 and the second terminal T2, respectively. When the temperature is lower than the switchover temperature TEs, the capacitance control circuit 51 connects both ends of the first capacitive element C1 to the first terminal T1 and the second terminal T2, respectively.

The phase compensation capacitance indicates a capacitance of the first capacitive element C1, or a capacitance of the second capacitive element C2, selectively. The capacitances of the first capacitive element C1 and the second capacitive element C2 are decreased as the temperature is increased.

Examples of circuit configurations of the temperature detection circuit 40 and the capacitance control circuit 51 provided in the phase compensation capacitance circuit 50 will be described below.

Figure 2:
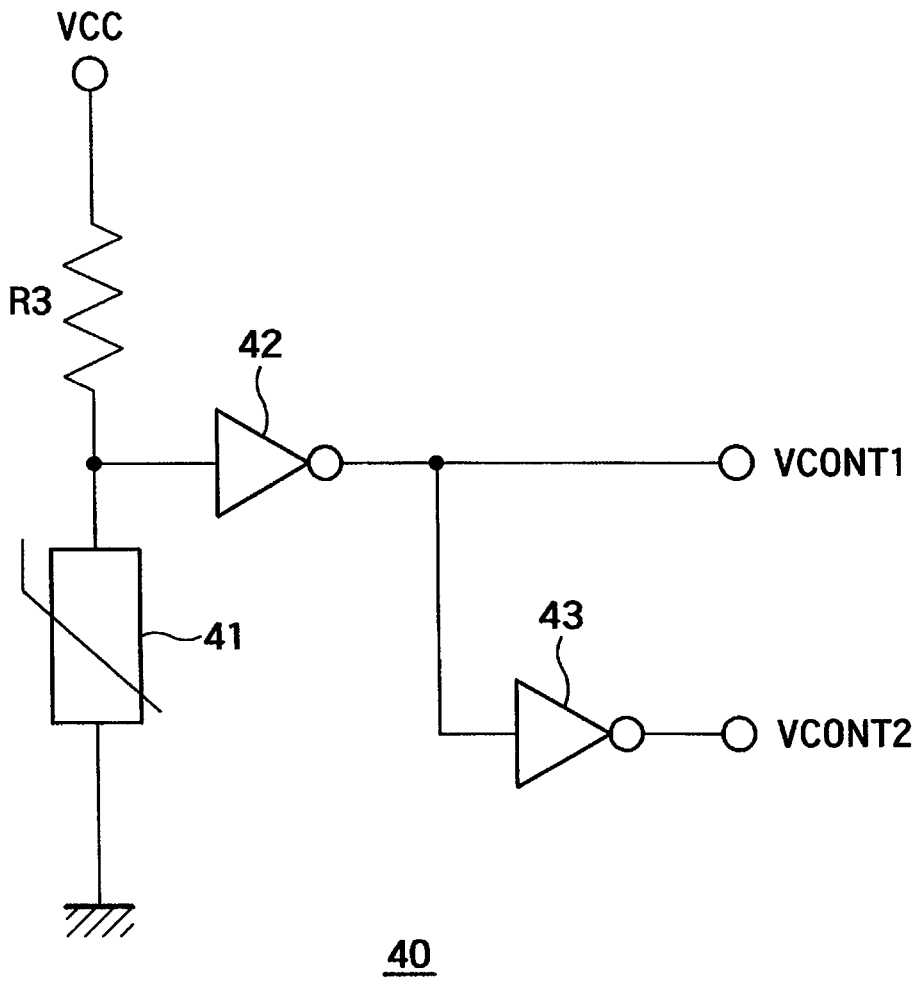
FIG. 2 is a circuit diagram showing a temperature detection circuit of the voltage regulator.

FIG. 2 is a circuit diagram showing the temperature detection circuit 40 of the voltage regulator of FIG. 1. As shown in FIG. 2, the temperature detection circuit 40 is provide with a resistor R3, a thermistor 41, and inverters 42, 43.

A power supply voltage VCC is supplied to one end of the resistor R3. The thermistor 41 is connected between the other end of the resistor R3 and the ground. A voltage signal of a connection point of the resistor R3 and the thermistor 41 is input to the inverter 42. The inverter 42 inverts the voltage signal and outputs the control signal VCONT1. The control signal VCONT1 is input to the inverter 43. The inverter 43 inverts the control signal VCONT1 and outputs the control signal VCONT2.

When the temperature is lower than the switchover temperature TEs, the resistance value of the thermistor 41 is low. Accordingly, the control signal VCONT1 is at a high level and the control signal VCONT2 is at a low level.

When the temperature is equal to or higher than the switchover temperature TEs, the resistance of the thermistor 41 is high. Accordingly, the control signal VCONT1 is at a low level and the control signal VCONT2 is at a high level.

Figure 3:
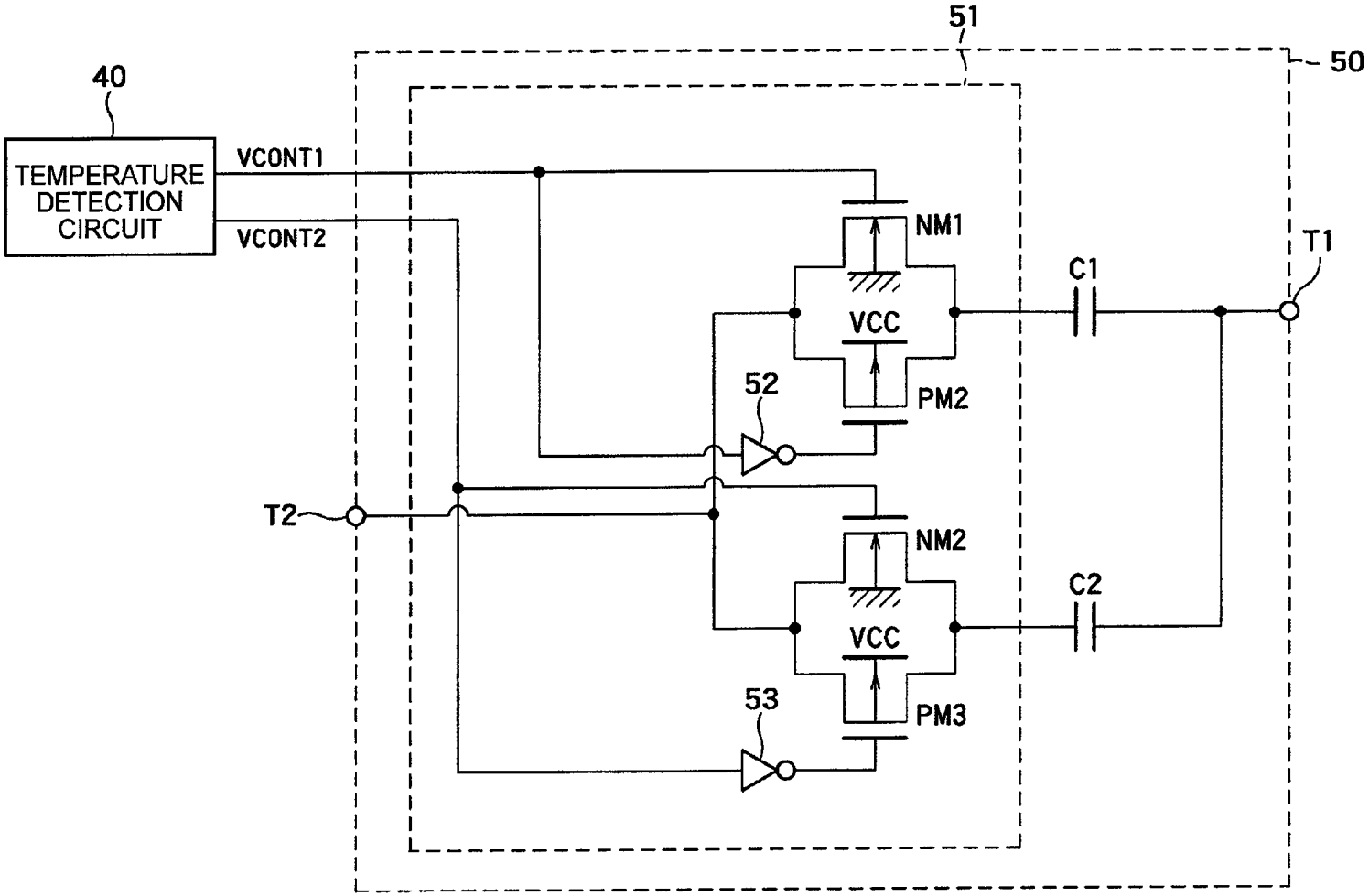
FIG. 3 is a circuit diagram showing a phase compensation capacitance circuit and a capacitance control circuit of the voltage regulator.

FIG. 3 is a circuit diagram showing a specific configuration of the phase compensation capacitance circuit 50 and the capacitance control circuit 51 shown in the voltage regulator FIG. 1. As shown in FIG. 3, the capacitance control circuit 51 is provide with N-channel MOS transistors NM1, NM2, P-channel MOS transistors PM2, PM3, and inverters 52, 53.

The inverter 52 inverts the control signal VCONT1 provided from the temperature detection circuit 40 and outputs an inverted signal. The inverter 53 inverts the control signal VCONT2 provided from the temperature detection circuit 40 and outputs an inverted signal.

The N-channel MOS transistor NM1 has a source, a drain and a gate. The source is connected to the second terminal T2. The drain is connected to one end of the first capacitive element C1. The gate receives the control signal VCONT1.

The P-channel MOS transistor PM2 has a source, a drain and a gate. The source is connected to the second terminal T2. The drain is connected to one end of the first capacitive element C1. The gate receives the output signal of the inverter 52.

The N-channel MOS transistor NM2 has a source, a drain and a gate. The source is connected to the second terminal T2. The drain is connected to one end of the second capacitive element C2. The gate receives the control signal VCONT2.

The P-channel MOS transistor PM3 has a source, a drain and a gate. The source is connected to the second terminal T2. The drain is connected to one end of the second capacitive element C2. The gate receives the output signal of the inverter 53.

The other end of the first capacitive element C1 and the other end of the second capacitive element C2 are connected to the first terminal T1.

An operation of the phase compensation capacitance circuit 50 will be described. When the control signal VCONT1 is at a high level and the control signal VCONT2 is at a low level, the N-channel MOS transistor NM1 and the P-channel MOS transistor PM2 are turned on and the N-channel MOS transistor NM2 and the P-channel MOS transistor PM3 are turned off. Accordingly, the first capacitive element C1 is electrically connected between the first terminal T1 and the second terminal T2.

On the other hand, when the control signal VCONT1 is at a low level and the control signal VCONT2 is at a high level, the N-channel MOS transistor NM1 and the P-channel MOS transistor PM2 are turned off and the N-channel MOS transistor NM2 and the P-channel MOS transistor PM3 are turned on. Accordingly, the second capacitive element C2 is electrically connected between the first terminal T1 and the second terminal T2.

Figure 4:
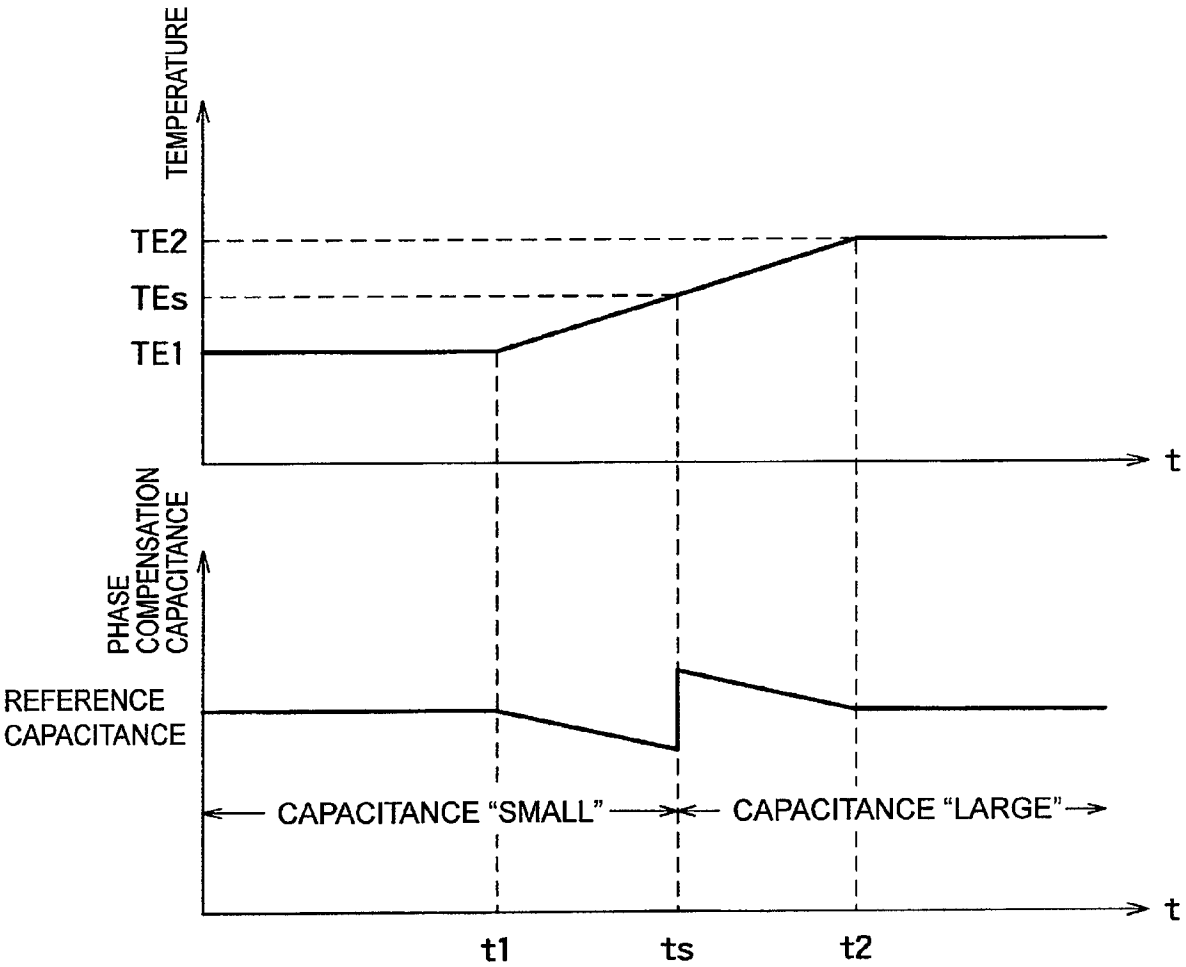
FIG. 4 is a view showing variations of temperature and phase compensation capacitance with a time with respect to the voltage regulator according to the first embodiment.

FIG. 4 is a view showing variations of temperature and phase compensation capacitance with a time with respect to the voltage regulator according to the first embodiment. The upper portion of FIG. 4 shows a temperature characteristic. In the temperature characteristic, the temperature is a constant temperature TE1 until a time t1. The temperature is monotonically raised after the time t1, reaches the switchover temperature TEs at a time ts, and then reaches a temperature TE2 at a time t2. The temperature is a constant temperature TE2 after the time t2.

In the example, since the temperature is lower than the switchover temperature TEs until the time ts, the capacitance control circuit 51 connects the first capacitive element C1 between the first terminal T1 and the second terminal T2 electrically. When the temperature is the temperature TE1, the capacitance of the first capacitive element C1 is a reference capacitance. Accordingly, the lower portion of FIG. 4 shows a characteristic of the phase compensation capacitance. The phase compensation capacitance is monotonically decreased from the reference capacitance from the time t1 to ts while the temperature is raised from the temperature TE1 to the switchover temperature TEs.

Similarly to the characteristic of the phase compensation capacitance shown in the lower portion of FIG. 4, the capacitance control circuit 51 connects the second capacitive element C2 between the first terminal T1 and the second terminal T2 electrically instead of the first capacitive element C1, at the time ts when the temperature becomes the switchover temperature TEs. The phase compensation capacitance is a capacitance of the first capacitive element C1 until the time ts which is a phase compensation switchover point, and is a capacitance of the second capacitive element C2 after the time ts. At the time ts, the phase compensation capacitance is switched from "small" to "large".

When the temperature is the temperature TE2, a capacitance of the second capacitive element C2 is a reference capacitance. Accordingly, even though the phase compensation capacitance is monotonically decreased from the time ts to t2 while the temperature is raised from the switchover temperature TEs to the temperature TE2, the reference capacitance can be maintained at the temperature TE2.

As described above, in the embodiment, when the temperature is the switchover temperature TEs, the capacitance of the first capacitive element C1 is smaller than the reference capacitance and the capacitance of the second capacitive element C2 is larger than the reference capacitance. Further, the difference between the reference capacitance and the capacitance of the first capacitive element C1 is equal to the difference between the capacitance of the second capacitive element C2 and the reference capacitance. With the above-mentioned setting, the phase compensation capacitance can approach the reference capacitance in a wider temperature range with respect to the switchover temperature TEs.

Figure 5:
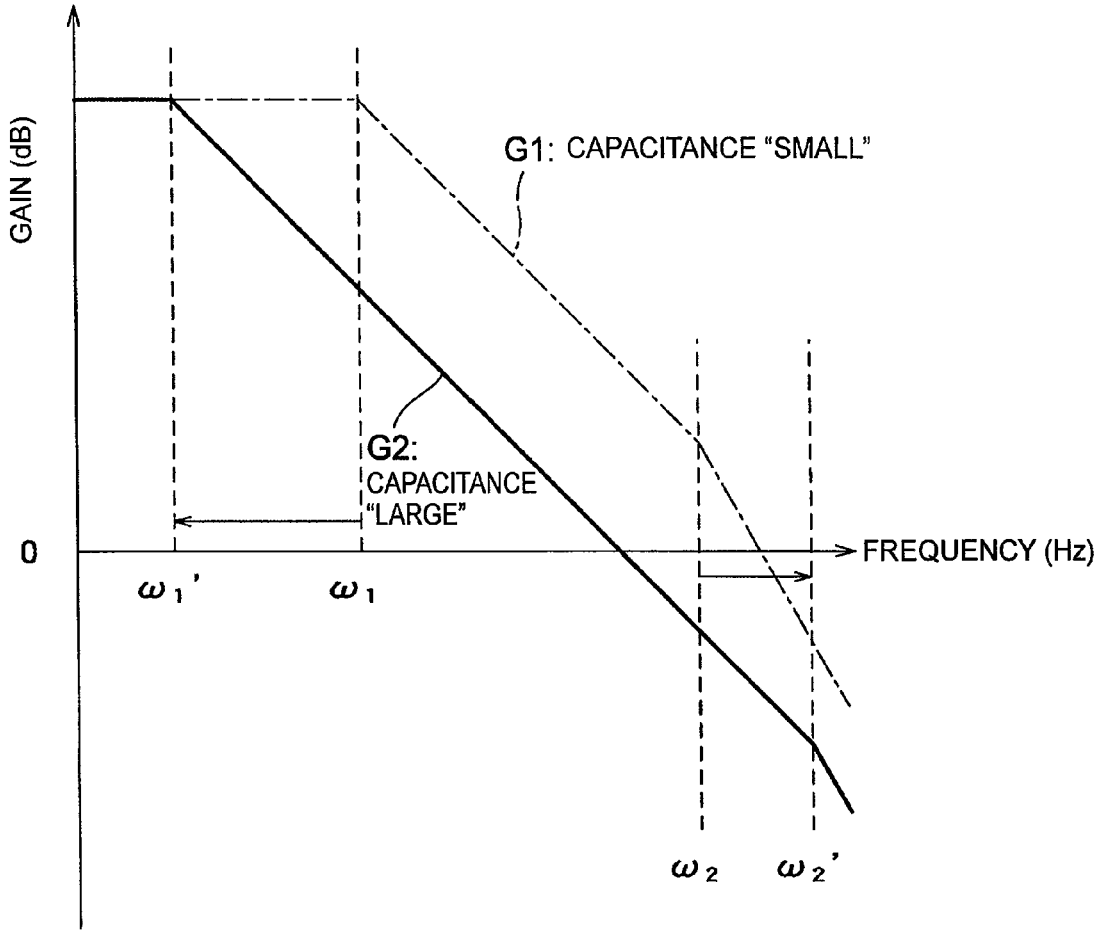
FIG. 5 is a view showing a frequency characteristic of gain in an open loop state of the voltage regulator according to the first embodiment.

FIG. 5 is a view showing a frequency characteristic of gain in an open loop state of the voltage regulator according to the first embodiment. In FIG. 5, a polygonal line G1 represents a frequency characteristic of gain immediately before the time ts in FIG. 4, i.e., a frequency characteristic of gain when the phase compensation capacitance is decreased by a rise in temperature. A polygonal line G2 represents a frequency characteristic of gain immediately after the time ts in FIG. 4, i.e., a frequency characteristic of gain when the phase compensation capacitance is large.

As shown by the polygonal line G1, when the phase compensation capacitance is decreased by a rise in temperature, a pole at a lower frequency side, i.e. a point at a lower frequency side where the transfer function of the voltage regulator is infinite is located at a frequency $\omega_1$, and a pole at a higher frequency side, i.e. a point at a higher frequency side where the transfer function of the voltage regulator is infinite is located at a frequency $\omega_2$. In other words, since the pole at the lower frequency side approaches the pole at the higher frequency side, the phase margin is reduced. When the phase compensation capacitance is lower than that of the polygonal line G1, the phase margin is further reduced so that the voltage regulator is easily oscillated.

As described with reference to FIG. 4, since the phase compensation capacitance is increased at the time ts, the frequency characteristic of gain is also changed from the polygonal line G1 to the polygonal line G2. With the change, as shown by the polygonal line G2, the pole at the lower frequency side moves to a frequency $\omega_1'$ which is lower than the frequency col and the pole at the higher frequency side moves to a frequency $\omega_2'$ which is higher than the frequency $\omega_2$. As described above, in the case of the polygonal line G2, the phase margin is sufficiently increased so that the voltage regulator is hard to be oscillated. Even though the temperature is raised, it is possible to allow the phase margin not to be too small which suppresses oscillation of the voltage regulator.

The phase compensation capacitance circuit 50 adjusts the phase compensation capacitance in accordance with the temperature detected by the temperature detection circuit 40 which serves as an operation environment. Accordingly, the frequency characteristic of a feedback loop of the voltage regulator can be appropriately adjusted in accordance with the temperature. As a result, the phase may be appropriately compensated without depending on the temperature so that the voltage regulator is hard to be oscillated.

As the phase compensation capacitance is decreased in accordance with rise in temperature, a slew rate which is determined by "current and/or capacitance" is increased. Accordingly, the overshoot at the time of raising the output voltage VOUT and the undershoot at the time of falling the output voltage VOUT are increased. However, when the temperature is equal to or higher than the switchover temperature TEs, the slew rate can be lowered by increasing the phase compensation capacitance. Accordingly, it is possible to suppress the overshoot at the time of raising the output voltage VOUT and the undershoot at the time of falling the output voltage VOUT, and to suppress deterioration in the characteristic of the voltage regulator by the change in temperature.

The embodiment shows a case where a phase compensation capacitance is adjusted by switching two capacitive elements C1, C2. However, the phase compensation capacitance may be adjusted by switching three or more capacitive elements. For example, if three capacitive elements are used, it is sufficient that an additional capacitive element having a larger capacitance than the second capacitive element C2 is provided in addition to the configuration of the first embodiment. In this case, when the temperature is equal to or higher than an additional switchover temperature which is higher than the switchover temperature TEs, the additional capacitive element may be provided in the phase compensation capacitance circuit 50, instead of the second capacitive element C2. When the temperature is lower than the additional switchover temperature and equal to or higher than the switchover temperature TEs, the second capacitive element C2 may be provided in instead of the additional capacitive element. With the configuration in which three or more capacitive elements are switched, the phase compensation capacitance can be adjusted so as to approach the reference capacitance further.

Figure 6:
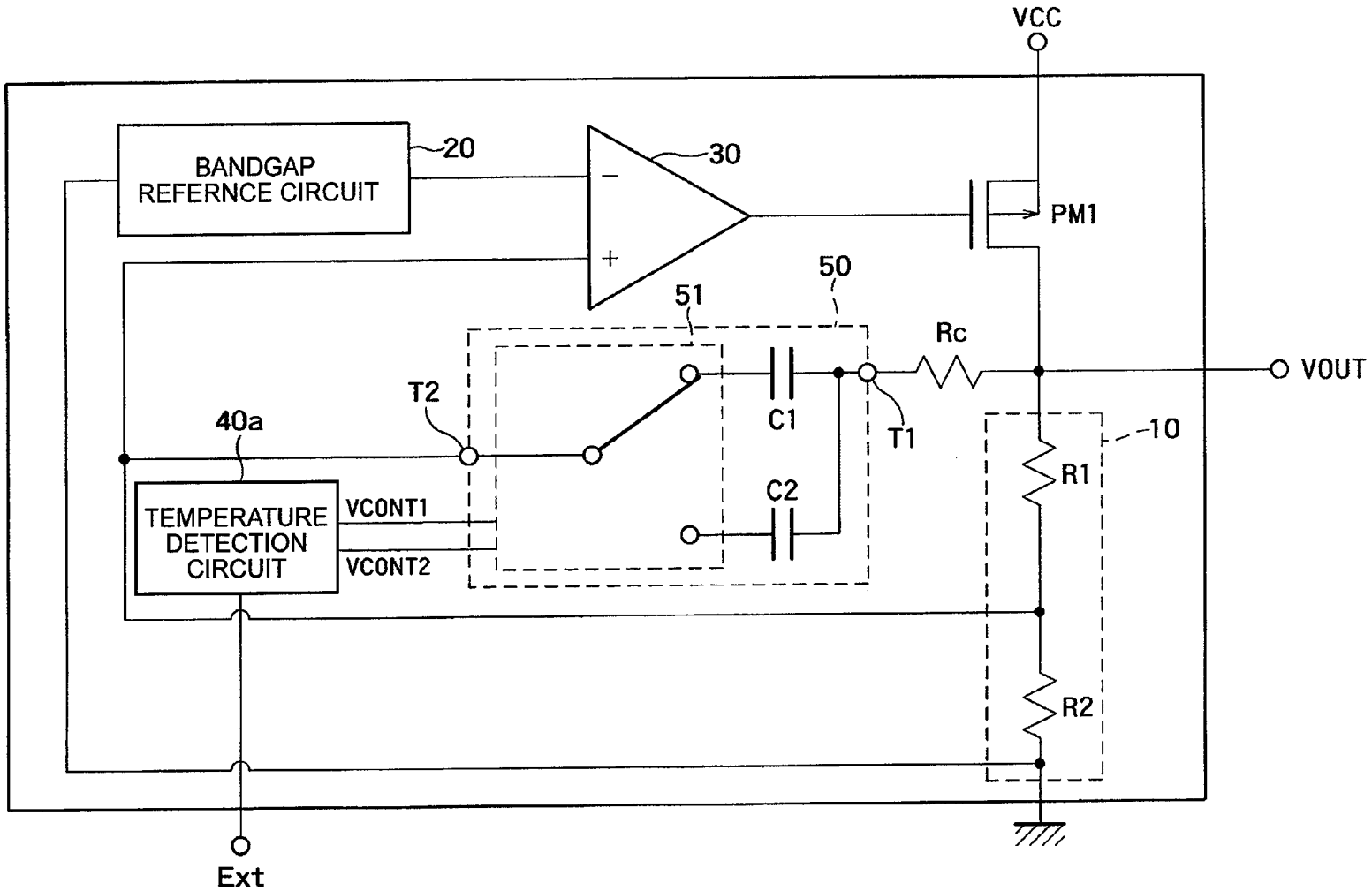
FIG. 6 is a circuit diagram showing a voltage regulator according to a modification of the first embodiment.
Figure 12:
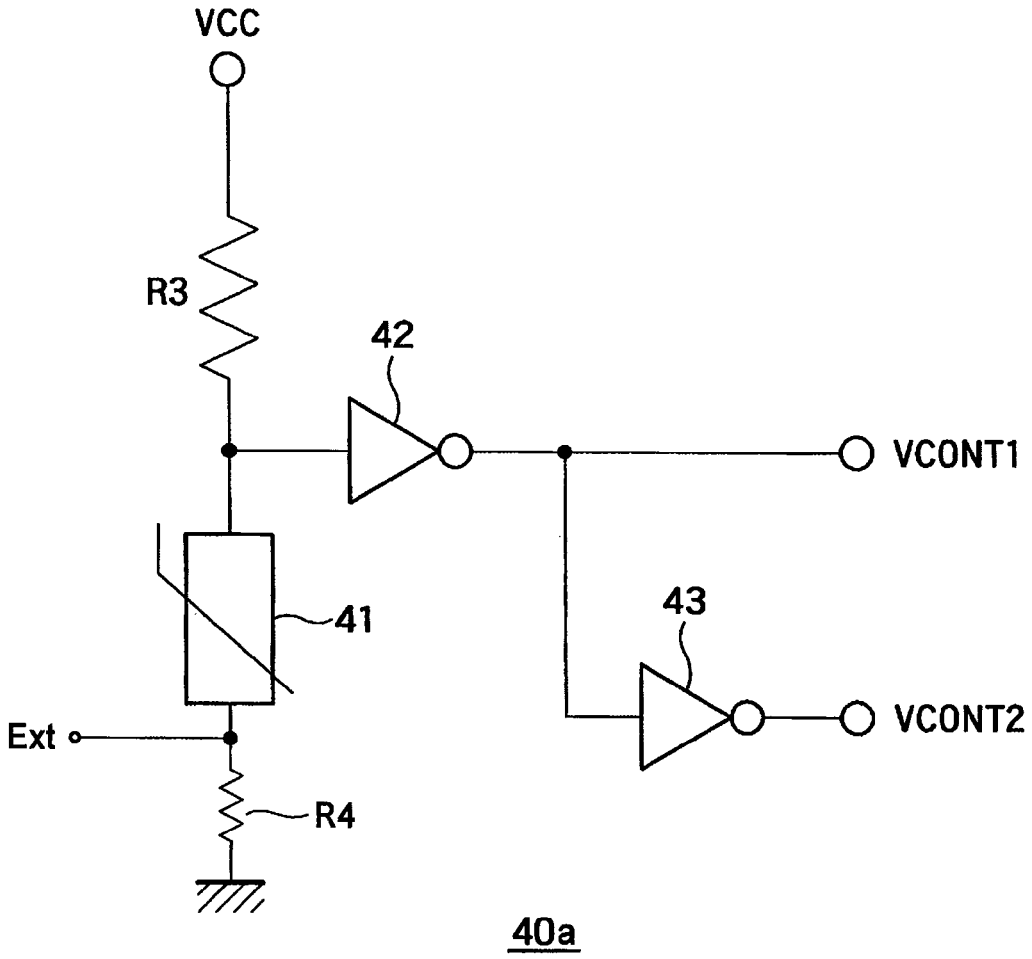
FIG. 12 is a circuit diagram showing a temperature detection circuit shown in FIG. 6.

FIG. 6 is a circuit diagram showing a voltage regulator according to a modification of the first embodiment. As shown in FIG. 6, the voltage regulator is different from that of the first embodiment in that a setting signal Ext is provided from outside to a temperature detection circuit 40*a*. The temperature detection circuit 40*a* is shown in FIG. 12, for example. The temperature detection circuit 40*a* is different from that shown in FIG. 2 in that a resistor R4 is connected between the thermistor 4 and a ground terminal. The setting signal Ext is provided to a connection point between the thermistor 4 and the resistor R4.

The temperature detection circuit 40*a* can arbitrarily set a switchover temperature TEs in accordance with the setting signal Ext. The switchover temperature TEs can be adjusted when the temperature range where the voltage regulator is used is changed by providing the setting signal Ex.

In the first embodiment, the temperature is detected as an operation environment of the voltage regulator. In contrast, in a second embodiment which will be described below, a frequency of a ripple which is contained in the power supply voltage VCC is detected as an operation environment.

Figure 7:
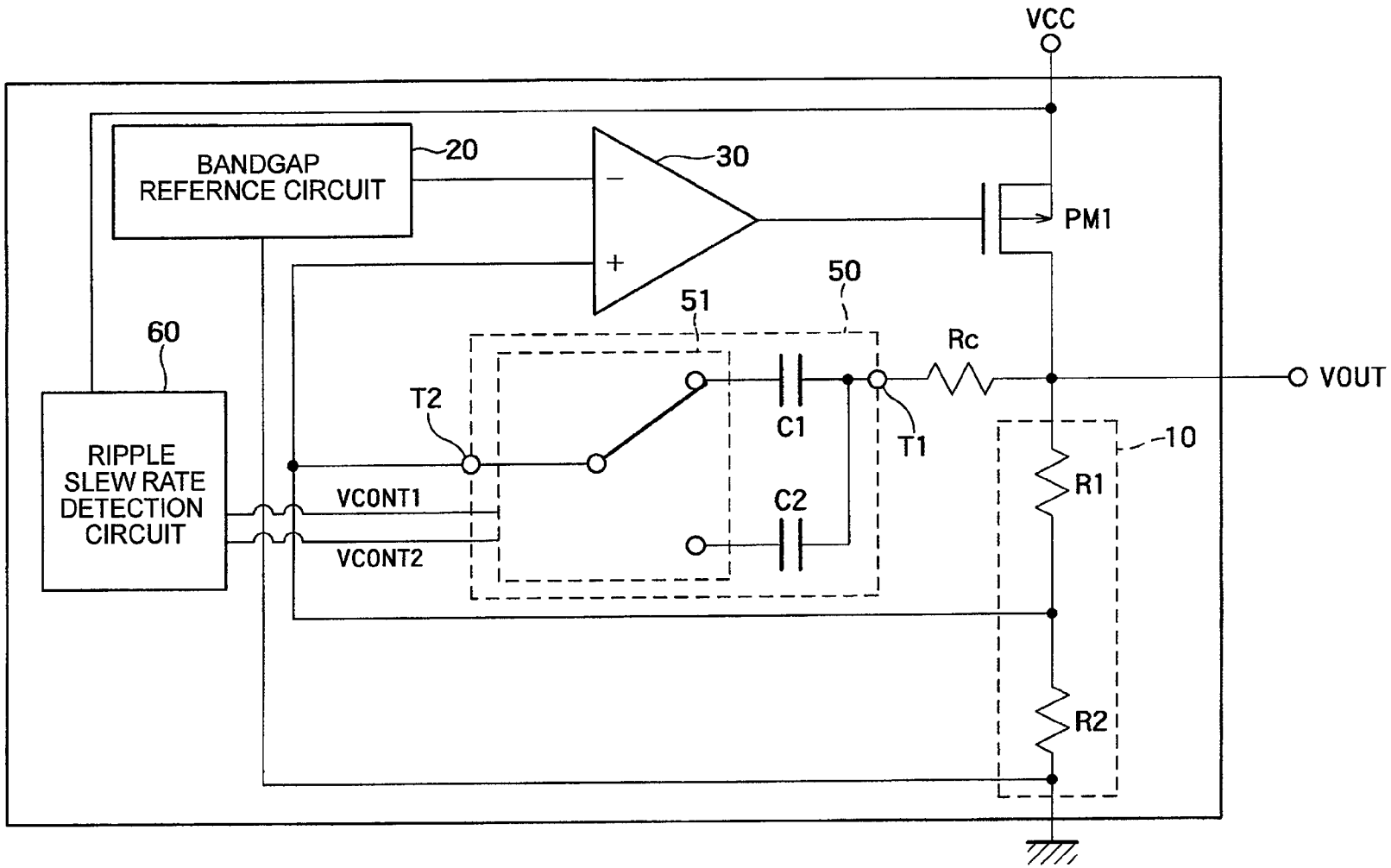
FIG. 7 is a circuit diagram showing a voltage regulator according to a second embodiment.

FIG. 7 is a circuit diagram showing a voltage regulator according to a second embodiment. As shown in FIG. 7, the voltage regulator is provided with a P-channel MOS transistor PM1 as an output transistor, a voltage dividing circuit 10, a bandgap reference circuit 20, an error amplifier 30, a phase compensation capacitance circuit 50, and a phase compensation resistor Rc, which is similar to the voltage regulator according to the first embodiment shown in FIG. 1. Further, the voltage regulator according to the second embodiment is provided with a ripple slew rate detection circuit 60 as a detection circuit whose detailed configuration will be described below.

The ripple slew rate detection circuit 60 detects a frequency of a ripple contained in the power supply voltage VCC supplied from the power supply as an operation environment. The frequency of a ripple is a slew rate of the ripple. The frequency of the ripple may be changed depending on the characteristic of the power supply. In the embodiment, when the frequency of the ripple is equal to or higher than a predetermined detected frequency, the ripple slew rate detection circuit 60 outputs a high level control signal VCONT1 and a low level control signal VCONT2. When the frequency of the ripple is lower than the predetermined detected frequency, the ripple slew rate detection circuit 60 outputs a low level control signal VCONT1 and a high level control signal VCONT2.

The phase compensation capacitance circuit 50 has a configuration shown in FIG. 3 and adjusts the phase compensation capacitance between a first terminal T1 and a second terminal T2 in accordance with the frequency of the ripple detected by the ripple slew rate detection circuit 60.

Specifically, when the detected frequency of the ripple is increased and the slew rate of the ripple is increased, the phase compensation capacitance circuit 50 adjusts the phase compensation capacitance so as to be reduced. When the detected frequency of the ripple is lowered and the slew rate of the ripple is decreased, the phase compensation capacitance circuit 50 adjusts the phase compensation capacitance so as to be increased.

As shown in FIG. 3, the phase compensation capacitance circuit 50 is provided with a first capacitive element C1, a second capacitive element C2 which has a higher capacitance than the first capacitive element C1, and a capacitance control circuit 51. In this case, capacitance values of the first capacitive element C1 and the second capacitive element C2 may be different from the capacitance values of the first embodiment.

When the detected frequency of the ripple is equal to or higher than the predetermined detected frequency, the capacitance control circuit 51 connects the first capacitive element C1 between the first terminal T1 and the second terminal T2 electrically, based on the control signals VCONT1, VCONT2. When the detected frequency of the ripple is lower than the predetermined detected frequency, the capacitance control circuit 51 connects the second capacitive element C2 between the first terminal T1 and the second terminal T2 electrically.

An example of a circuit configuration of the ripple slew rate detection circuit 60 will be described below.

Figure 8A:
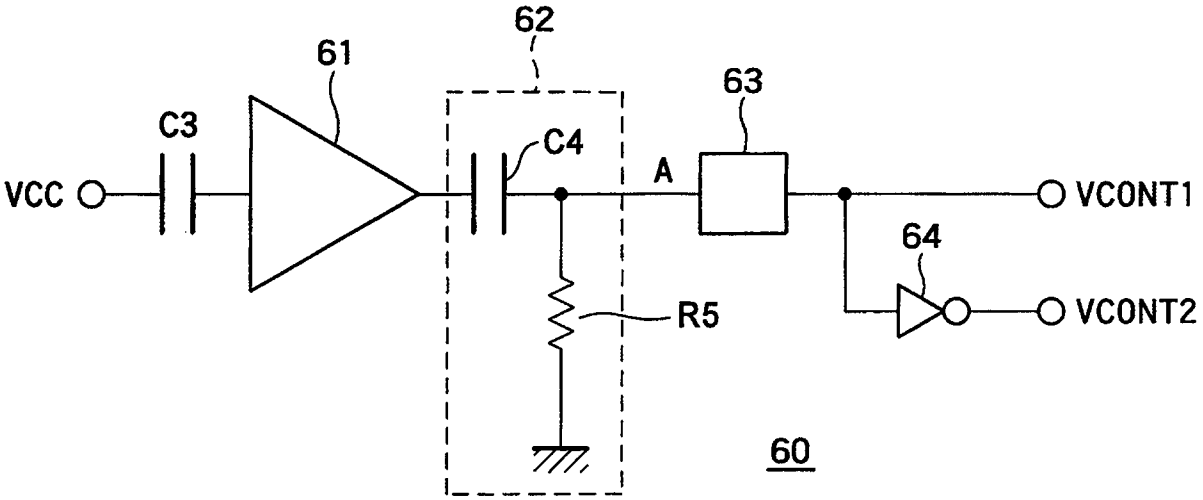
FIG. 8A is a circuit diagram showing a configuration of a ripple slew rate detection circuit of the voltage regulator according to the second embodiment.
Figure 8B:
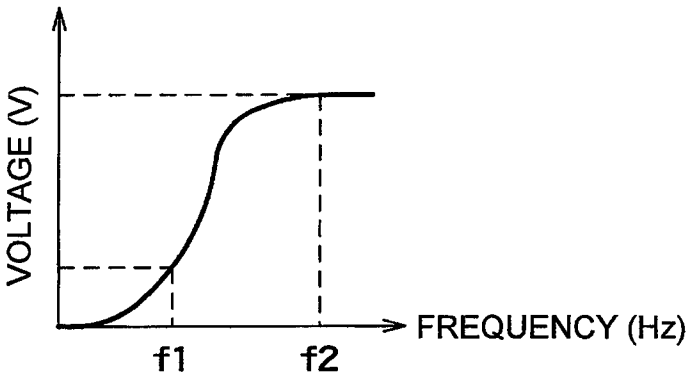
FIG. 8B is a view for explaining a frequency characteristic of the ripple slew rate detection circuit shown in FIG. 8A.

FIG. 8A is a circuit diagram showing a configuration of the ripple slew rate detection circuit 60 according to the second embodiment. FIG. 8B is a view for explaining a frequency characteristic of the ripple slew rate detection circuit 60. As shown in FIG. 8A, the ripple slew rate detection circuit 60 is provided with a third capacitive element C3, an amplifier 61, a high pass filter 62, a control signal output circuit 63, and an inverter 64, respectively connected with each other in this order. The high pass filter 62 has a capacitance C4 and a resistor R5. One end of the capacitance C4 is connected with an output terminal of the amplifier 61, and the other end of the capacitance C4 is connected with one end of the resistor R5.

The power supply voltage VCC is supplied to one end of the third capacitive element C3. The ripple contained in the power supply voltage VCC is also provided to the one end of the third capacitive element C3.

The amplifier 61 is connected to the other end of the third capacitive element C3 and amplifies a component of the ripple contained in the power supply voltage VCC.

The high pass filter 62 extracts a signal component, which is contained in an output signal of the amplifier 61 and is equal to or higher than the predetermined detection frequency. An output of the high pass filter 62 is provided to the control signal output circuit 63. The control signal output circuit 63 outputs a control signal VCONT1. The inverter 64 inverts the control signal VCONT1, and outputs a control signal VCONT2.

FIG. 8B shows a frequency characteristic of a voltage at a point A which is an output terminal of the high pass filter 62. As shown in FIG. 8B, a voltage of a signal component of a frequency f1 which is lower than the predetermined detection frequency is low, and a voltage of a signal component of a frequency f2 which is equal to or higher than the predetermined detection frequency is high.

The control signal output circuit 63 is connected to the output terminal of the high pass filter 62. The control signal output circuit 6 outputs a high level control signal VCONT1 which indicates that the frequency of the ripple is equal to or higher than the predetermined detected frequency, while the signal component which is equal to or higher than the predetermined detected frequency is extracted by the high pass filter 62. Further, the control signal output circuit 63 outputs a low level control signal VCONT1 which indicates that the frequency of the ripple is lower than the predetermined detected frequency, while the signal component which is equal to or higher than the predetermined detected frequency is not extracted by the high pass filter 62.

The inverter 64 inverts the control signal VCONT1 and outputs a control signal VCONT2.

Figure 9:
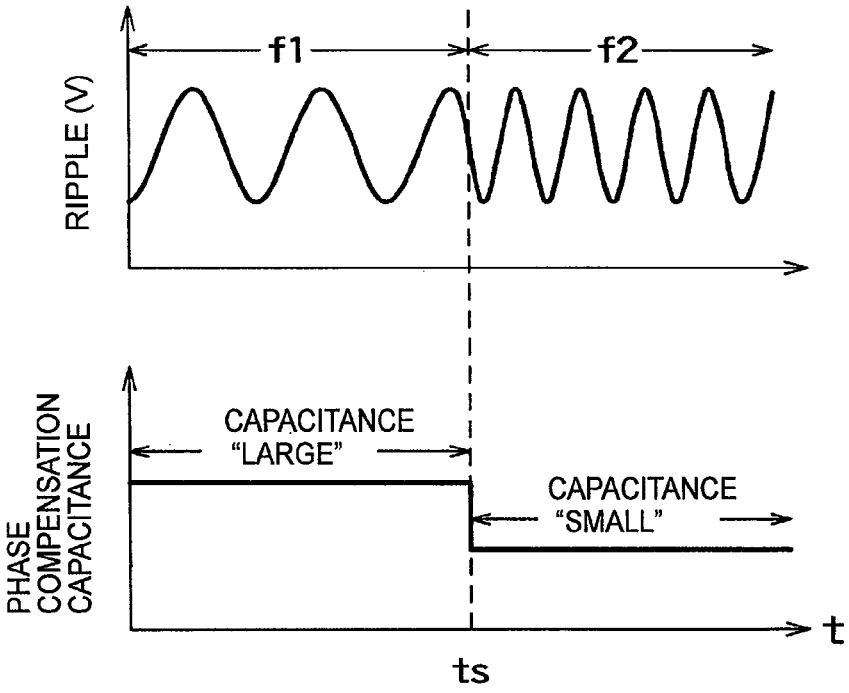
FIG. 9 is a view showing variations of ripple and phase compensation capacitance with a time with respect to the voltage regulator according to the second embodiment.

FIG. 9 is a view showing variations of ripple and phase compensation capacitance with a time with respect to the voltage regulator according to the second embodiment. The upper portion of FIG. 9 indicates a ripple characteristic. According to the ripple characteristic shown in the upper portion of FIG. 9, the frequency of the ripple contained in the power supply voltage VCC is maintained to be a frequency f1 which is lower than the predetermined detected frequency, until a time ts. The frequency of the ripple becomes a frequency f2 which is equal to or higher than the predetermined detected frequency, after the time ts.

In this case, according to the characteristic of the phase compensation capacitance shown in the lower portion of FIG. 9, the second capacitive element C2 is electrically connected between the first terminal T1 and the second terminal T2 in the capacitance control circuit 51, until the time ts. The first capacitive element C1 is electrically connected between the first terminal T1 and the second terminal T2 in the capacitance control circuit 51 instead of the second capacitive element C2, at the time ts. The phase compensation capacitance is large until the time ts which is a switchover point of the phase compensation capacitance. The phase compensation capacitance is small after the time ts.

Figure 10:
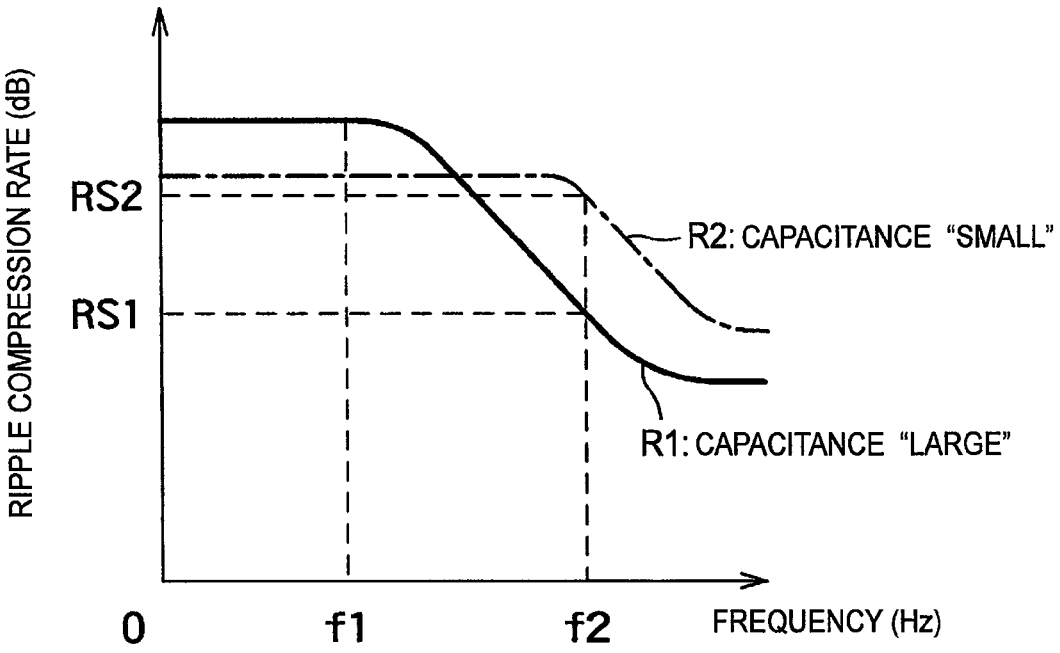
FIG. 10 is a view showing a frequency characteristic of a ripple compression rate of the voltage regulator according to the second embodiment.

FIG. 10 is a view showing the frequency characteristic of a ripple compression rate of the voltage regulator according to the second embodiment. In FIG. 10, a curve R1 indicates a case where the phase compensation capacitance is a capacitance of the second capacitive element C2 and a curve R2 indicates a case where the phase compensation capacitance is a capacitance of the first capacitive element C1. The ripple compression rate shows a compression rate of ripple represented by a logarithm. The compression rate of ripple is a rate of a ripple arising in the output voltage VOUT of the voltage regulator with respect to the ripple contained in the power supply voltage VCC.

As shown in FIG. 10, according to the curve R1, the ripple compression rate is sufficiently high at the low frequency f1, but a ripple compression rate RS1 at the high frequency f2 is significantly lower than the ripple compression rate at the frequency f1.

According to the curve R2, the ripple compression rate at the low frequency f1 is lower than that of the curve R1, but a ripple compression rate RS2 at the high frequency f2 is higher than the ripple compression rate RS1 of the curve R1. In the curve R2, the ripple compression rate RS2 at the high frequency f2 has a value close to the ripple compression rate at the low frequency f1.

As described above, when the frequency of the ripple is high, a pole on the lower frequency side can be moved to the higher frequency side by decreasing the phase compensation capacitance. Accordingly, it is possible to increase the ripple compression rate at a high frequency of the ripple.

When the frequency of the ripple is low, a pole on the lower frequency side can be moved to the lower frequency side by increasing the phase compensation capacitance increase an output impedance of the open loop. Accordingly, it is possible to increase the ripple compression rate at the low frequency.

As described above, according to the embodiment, the phase compensation capacitance circuit 50 adjusts the phase compensation capacitance in accordance with the frequency of the ripple as an operation environment which is detected by the ripple slew rate detection circuit 60.

Accordingly, the frequency characteristic of a feedback loop of the voltage regulator can be appropriately adjusted in accordance with the frequency of the ripple. Since the compression of the ripple can be appropriately performed without depending on the frequency of the ripple, the ripple contained in the output voltage VOUT of the voltage regulator can be decreased so that the deterioration in characteristic due to change in the frequency of the ripple can be suppressed.

In the above embodiment, the phase compensation capacitance is adjusted by switching the two capacitive elements C1, C2. The phase compensation capacitance may be adjusted by switching three or more capacitive elements. For example, if three capacitive elements are used, it is sufficient that an additional capacitive element having a smaller capacitance than the first capacitive element C1 is provided in addition to the configuration of the first embodiment. In this case, in the phase compensation capacitance circuit 50, when the frequency of the ripple is equal to or higher than an additional predetermined detected frequency which is higher than a predetermined detected frequency, the additional capacitive element may be provided instead of the first capacitive element C1. When the frequency of the ripple is lower than the additional predetermined detected frequency and equal to or higher than the predetermined detected frequency, the first capacitive element C1 may be provided instead of the additional capacitive element. By using such a configuration in which three or more capacitive elements are switched, the phase compensation capacitance can be more specifically adjusted.

Figure 11:
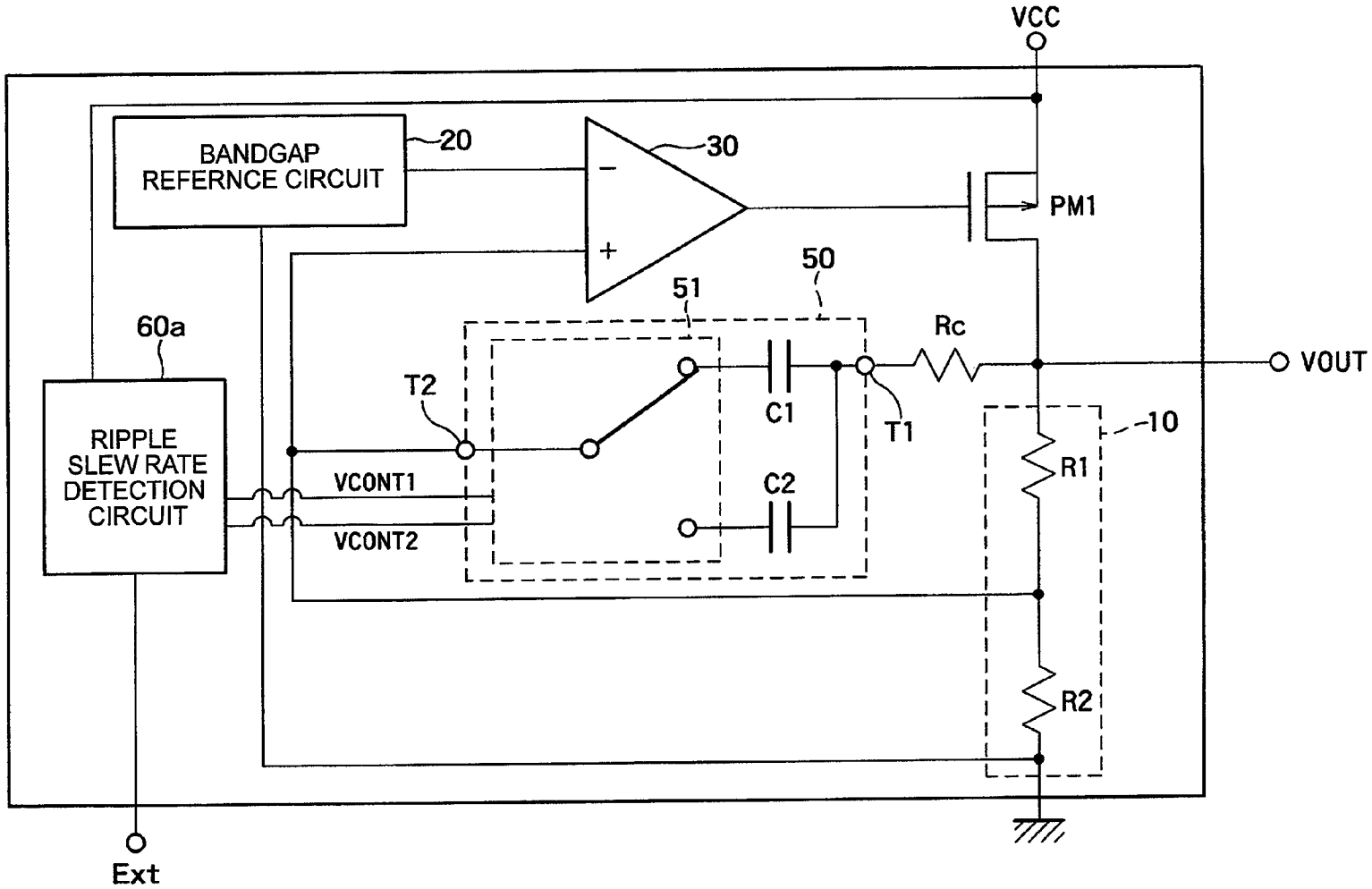
FIG. 11 is a circuit diagram showing a voltage regulator according to a modification of the second embodiment.
Figure 13:
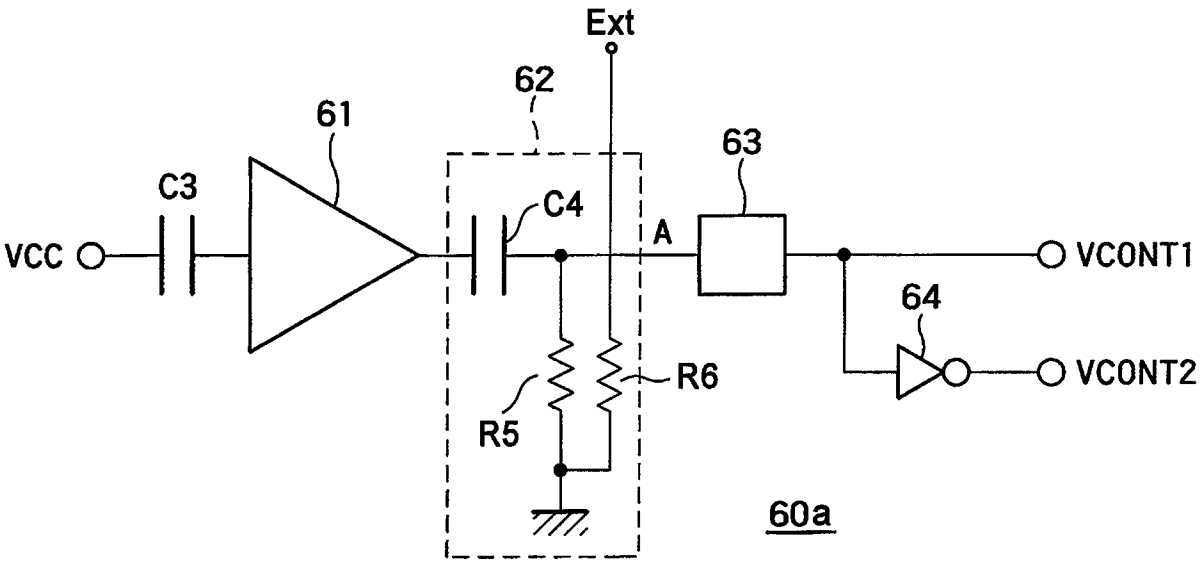
FIG. 13 is a circuit diagram showing of a ripple slew rate detection circuit shown in FIG. 11.

FIG. 11 is a circuit diagram showing a voltage regulator according to a modification of the second embodiment. As shown in FIG. 11, the voltage regulator is different from that of the second embodiment in that a setting signal Ext is provided from outside to a ripple slew rate detection circuit 60*a*. The ripple slew rate detection circuit 60*a* is shown in FIG. 13, for example. The ripple slew rate detection circuit 60*a* is different from that shown in FIG. 8A in that one end of a resistor R6 is connected to a connection point between the resistor R5 and a ground terminal. The setting signal Ext is provided to the other end of the resistor R6.

The ripple slew rate detection circuit 60*a* can arbitrarily set a detection frequency in accordance with the setting signal Ext. Accordingly, even when a power supply used in the voltage regulator is replaced with another power supply and the frequency of the ripple is changed, the detection frequency can be adjusted.

At least some of first and second conductivity type MOS transistors (P-channel and N-channel MOS transistors) used in the embodiments and the modifications may be replaces with other semiconductor elements such as first and second conductivity type bipolar transistors (PNP and NPN bipolar transistors). Further, instead of the P-channel MOS transistor PM1 an output transistor, an N-channel MOS transistor may be used.

According to the embodiments and the modifications, the phase compensation capacitance circuit 50 is provided to suppress deterioration in characteristic to be caused by change in an operation environment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A voltage regulator, comprising:

an output transistor having a first end to which a power supply voltage is supplied, a control terminal to which a control signal is input, and a second end which outputs an output voltage;

a voltage dividing circuit which is connected between the second end of the output transistor and a first reference voltage, the voltage dividing circuit being configured to output a divided voltage according to the output voltage;

an error amplifier which has a first input terminal to which the divided voltage is provided, and a second input terminal to which a second reference voltage is provided, the error amplifier being configured to output the control signal according to a difference between the divided voltage and the second reference voltage;

a detection circuit configured to detect an operation environment; and a phase compensation capacitance circuit configured to adjust a phase compensation capacitance between the second end of the output transistor and the first input terminal of the error amplifier in accordance with the operation environment, wherein the detection circuit is configured to detect a temperature as the operation environment, the phase compensation capacitance has a temperature dependency, and the phase compensation capacitance circuit is configured to adjust the phase compensation capacitance so as to approach a predetermined reference capacitance in accordance with the detected temperature.

2. The voltage regulator according to claim 1, wherein the phase compensation capacitance circuit includes:

a first capacitive element which has a temperature dependency;

a second capacitive element which has a temperature dependency and has a higher capacitance than the first capacitive element; and a capacitance control circuit, the capacitance control circuit connecting the second capacitive element between the second end of the output transistor and the first input terminal of the error amplifier electrically when the temperature detected by the detection circuit is equal to or higher than a predetermined switchover temperature, and the capacitance control circuit connecting the first capacitive element between the second end of the output transistor and the first input terminal of the error amplifier electrically when the temperature detected by the detection circuit is lower than the predetermined switchover temperature.

3. The voltage regulator according to claim 2, wherein when the temperature is the switchover temperature, the capacitance of the first capacitive element is smaller than the reference capacitance, the capacitance of the second capacitive element is larger than the reference capacitance, and a difference between the reference capacitance and the capacitance of the first capacitive element is equal to a difference between the capacitance of the second capacitive element and the reference capacitance.

4. The voltage regulator according to claim 2, wherein the detection circuit is configured to set the switchover temperature in accordance with a setting signal from outside.

5. The voltage regulator according to claim 2, wherein the detection circuit is configured to output first and second control signals, and the capacitance control circuit is provided with first and second transistors of a first conductivity type, third and fourth transistors of a second conductivity type, and first and second inverters, a first end of each of the first to fourth transistors is connected to the first input terminal of the error amplifier, a second end of each of the first and third transistors is connected to the first capacitive element, a second end of each of the second and fourth transistors is connected to the second capacitive element, a first end of each of the first and second inverters is connected to control ends of the second and fourth transistors, a first control signal which is output from the detection circuit is input to a control end of the first transistor and a second end of the first inverter, and a second control signal which is output from the detection circuit is input to a control terminal of the third transistor and a second end of the second inverter.

6. The voltage regulator according to claim 5, wherein the output transistor and the first to fourth transistors are insulated gate field effect transistors.

7. A voltage regulator, comprising:

an output transistor having a first end to which a power supply voltage is supplied, a control terminal to which a control signal is input, and a second end which outputs an output voltage;

a voltage dividing circuit which is connected between the second end of the output transistor and a first reference voltage, the voltage dividing circuit being configured to output a divided voltage according to the output voltage;

an error amplifier which has a first input terminal to which the divided voltage is provided, and a second input terminal to which a second reference voltage is provided, the error amplifier being configured to output the control signal according to a difference between the divided voltage and the second reference voltage;

a detection circuit configured to detect an operation environment; and a phase compensation capacitance circuit configured to adjust a phase compensation capacitance between the second end of the output transistor and the first input terminal of the error amplifier in accordance with the operation environment, wherein the detection circuit includes a serial circuit of a resistor and a thermistor, and first and second inverters, the serial circuit is connected between the power supply voltage and the reference voltage, a first end of the first inverter is connected at a connection point of the resistor and the thermistor and a second end of the first inverter outputs a first control signal which is provided to the phase compensation capacitance circuit, a first end of the second inverter is connected to the second end of the first inverter, and a second end of the second inverter outputs a second control signal which is provided to the phase compensation capacitance circuit.

8. A voltage regulator, comprising:

an output transistor having a first end to which a power supply voltage is supplied, a control terminal to which a control signal is input, and a second end which outputs an output voltage;

a voltage dividing circuit which is connected between the second end of the output transistor and a first reference voltage, the voltage dividing circuit being configured to output a divided voltage according to the output voltage;

an error amplifier which has a first input terminal to which the divided voltage is provided, and a second input terminal to which a second reference voltage is provided, the error amplifier being configured to output the control signal according to a difference between the divided voltage and the second reference voltage;

a detection circuit configured to detect an operation environment; and a phase compensation capacitance circuit configured to adjust a phase compensation capacitance between the second end of the output transistor and the first input terminal of the error amplifier in accordance with the operation environment, wherein the detection circuit is configured to detect a frequency of a ripple contained in the power supply voltage as the operation environment, and the phase compensation capacitance circuit is configured to adjust the phase compensation capacitance so as to be smaller when the detected frequency of the ripple becomes high, and is configured to adjust the phase compensation capacitance so as to be larger when the detected frequency of the ripple becomes low.

9. The voltage regulator according to claim 8, wherein the phase compensation capacitance circuit includes:

a first capacitive element;

a second capacitive element having a larger capacitance than the first capacitive element; and a capacitance control circuit, the capacitance control circuit connecting the first capacitive element between the second end of the output transistor and the first input terminal of the error amplifier electrically when the detected frequency of the ripple is equal to or higher than a predetermined detection frequency, and the capacitance control circuit connecting the second capacitive element between the second end of the output transistor and the first input terminal of the error amplifier electrically when the detected frequency of the ripple is lower than a predetermined detection frequency.

10. The voltage regulator according to claim 9, wherein the detection circuit includes a third capacitive element, an amplifier and a high pass filter, the power supply voltage is configured to be supplied to a first end of the third capacitive element, a second end of the third capacitive element is connected to one end of the amplifier, the amplifier amplifies the ripple contained in the power supply voltage, and the high pass filter is configured to extract a signal component contained in an output signal of the amplifier which is equal to or higher than the predetermined detection frequency.

11. The voltage regulator according to claim 9, wherein the detection circuit is configured to set the predetermined detection frequency in accordance with a setting signal from outside.

12. The voltage regulator according to claim 9, wherein the detection circuit is configured to output first and second control signals, and the capacitance control circuit is provided with first and second transistors of a first conductivity type, third and fourth transistors of a second conductivity type, and first and second inverters, a first end of each of the first to fourth transistors is connected to the first input terminal of the error amplifier, a second end of each of the first and third transistors is connected to the first capacitive element, a second end of each of the second and fourth transistors is connected to the second capacitive element, a first end of each of the first and second inverters is connected to control ends of the second and fourth transistors, a first control signal which is output from the detection circuit is input to a control end of the first transistor and a second end of the first inverter, and a second control signal which is output from the detection circuit is input to a control terminal of the third transistor and a second end of the second inverter.

13. The voltage regulator according to claim 12, wherein the output transistor and the first to fourth transistors are insulated gate field effect transistors.

* * * * *